United States Patent [19]

Hayashi

[11] Patent Number: 4,559,907

[45] Date of Patent: Dec. 24, 1985

[54] LOAD RESPONSIVE TEMPERATURE CONTROL ARRANGEMENT FOR INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 593,252

[22] Filed: Mar. 26, 1984

[30] Foreign Application Priority Data

Mar. 31, 1983 [JP] Japan ..... 58-53787
Aug. 8, 1983 [JP] Japan ..... 58-144711

[51] Int. Cl.[4] ..... F01P 3/22

[52] U.S. Cl. ..... 123/41.12; 123/41.21; 123/41.44

[58] Field of Search ..... 123/41.11, 41.12, 41.2, 123/41.21, 41.24, 41.27, 41.44, 41.51–41.54; 340/59; 73/304 R

[56] References Cited

U.S. PATENT DOCUMENTS

| | | | |
|---|---|---|---|
| 1,376,086 | 4/1921 | Fairman | 123/41.2 |
| 2,420,436 | 5/1947 | Mallory | 123/41.02 |
| 4,367,699 | 1/1983 | Evans | 123/41.23 |
| 4,381,736 | 5/1983 | Hirayama | 123/41.44 |

FOREIGN PATENT DOCUMENTS

| | | | |
|---|---|---|---|
| 0059423 | 9/1982 | European Pat. Off. . | |
| 522617 | 4/1931 | Fed. Rep. of Germany . | |
| 736381 | 6/1943 | Fed. Rep. of Germany . | |
| 3024209 | 1/1981 | Fed. Rep. of Germany | 123/41.44 |
| 3018076 | 11/1981 | Fed. Rep. of Germany . | |
| 1224308 | 6/1960 | France . | |
| 57-16219 | 1/1982 | Japan . | |
| 57-57608 | 12/1982 | Japan . | |
| 2064817 | 6/1982 | United Kingdom . | |

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to optimize (with respect to engine load) the temperature and/or pressure prevailing in the coolant jacket of an engine wherein the coolant is boiled and the vapor thereof used as a vehicle for removing heat, the load is sensed and a fan or like device suitably controlled to cool the radiator in a manner that the temperature and/or pressure prevailing in the coolant jacket is raised to a suitable level to promote fuel economy during urban cruising and reduced for high speed and/or high load (e.g. hill climbing) to avoid engine knocking and/or piston seizure.

11 Claims, 13 Drawing Figures

LOAD RESPONSIVE TEMPERATURE CONTROL ARRANGEMENT FOR INTERNAL COMBUSTION ENGINE

BACKGROUND OF THE INVENTION

1. Field of the Invention

The present invention relates generally to an internal combustion engine of the type wherein coolant is "boiled off" to make use of the latent heat of evaporation of the coolant and the coolant vapor used as a heat transfer medium, and more specifically to an improved temperature control arrangement therefor which can adjust the engine temperature appropriately in response to engine load.

2. Description of the Prior Art

In currently used "water cooled" internal combustion engines, the engine coolant (liquid) is forcefully circulated by a water pump through a circuit including the engine coolant jacket and a radiator (usually fan cooled). However, in this type of system a drawback is encountered in that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having 1800 cc displacement (by way of example) operated at full throttle, the cooling system is required to remove approximately 4000 Kcal/h. In order to achieve this a flow rate of 167 l/min (viz., 4000 - $60\times\frac{1}{4}$) must be produced by the water pump. This of course undesirably consumes a number of horsepower.

Moreover, with the above type of engine cooling system, the temperature of the coolant is prevented from boiling and maintained within a predetermined narrow temperature range irrespective of the load and/or mode of operation of the engine, despite the fact that it is advantageous from the point of fuel economy to raise the temperature of the engine during low-medium load "urban" cruising and reduce same during high speed and/or high load (full throttle) modes of operation for engine protection.

One arrangement via which the temperature of the engine may be varied in response to load is disclosed in U.S. Pat. No. 2,420,436 issued on May 1947 in the name of Mallory. This document discloses an arrangement wherein the volume of water in the cooling system is increased and decreased in response to engine temperature and load. However, with this arrangement only the water level in the radiator is varied while the water jacket, formed in the cylinder block and cylinder head, remains full under the influence of a water circulation pump. Accordingly, this arrangement has suffered from the drawback that a power consuming water circulation pump is required, the amount by which the temperature can be increased is limited by the fact that the water is prevented from boiling and in that the notable mass of water increases the weight and warm-up time of the engine.

Another arrangement of achieving the desired temperature control has included the use of a "dual" cooling system including two radiators which can be selectively used in response to engine load. However, the weight of such a system is prohibitive while simultaneously incurring the drawbacks of slow warm-up and limited temperature variation range.

SUMMARY OF THE INVENTION

It is an object of the present invention to provide an arrangement which obivates the use of a water circulation pump of the nature used in conventional engines, which can, in response to various modes of engine operation, readily raise and lower the temperature of the engine to required degrees and which further exhibits rapid warm-up characteristics.

In brief, this object is fullfilled by using a cooling system wherein the coolant is boiled and the vapor used as a vehicle for removing heat. Load and engine speed parameters are sensed and a fan or like device suitably energized or operated to control the cooling of the radiator, and therefore the rate of condensation therein, in a manner that the temperature and/or pressure prevailing in the coolant jacket is raised to a suitable level to promote fuel economy during urban cruising and reduced for high speed and/or high load (e.g. hill climbing) to avoid engine knocking and/or piston seizure.

More specifically, the present invention takes the form of an internal combustion engine which features a radiator, a coolant jacket in which coolant is boiled and the vapor produced condensed in the radiator, a first sensor for sensing a first parameter which varies with the load on the engine, a second sensor for sensing a second parameter which varies with the temperature of the coolant, and an arrangement responsive to the first and second sensors for varying the rate of condensation of the gaseous coolant in the radiator.

BRIEF DESCRIPTION OF THE DRAWINGS

The features and advantages of the arrangement of the present invention will become more clearly appreciated from the following description taken in conjunction with the accompanying drawings in which:

FIG. 10 is flow chart showing the steps which characterize the operation of an embodiment utilizing a microprocessor or the like.

DETAILED DESCRIPTION OF THE PREFERRED EMBODIMENTS

Figure 1:
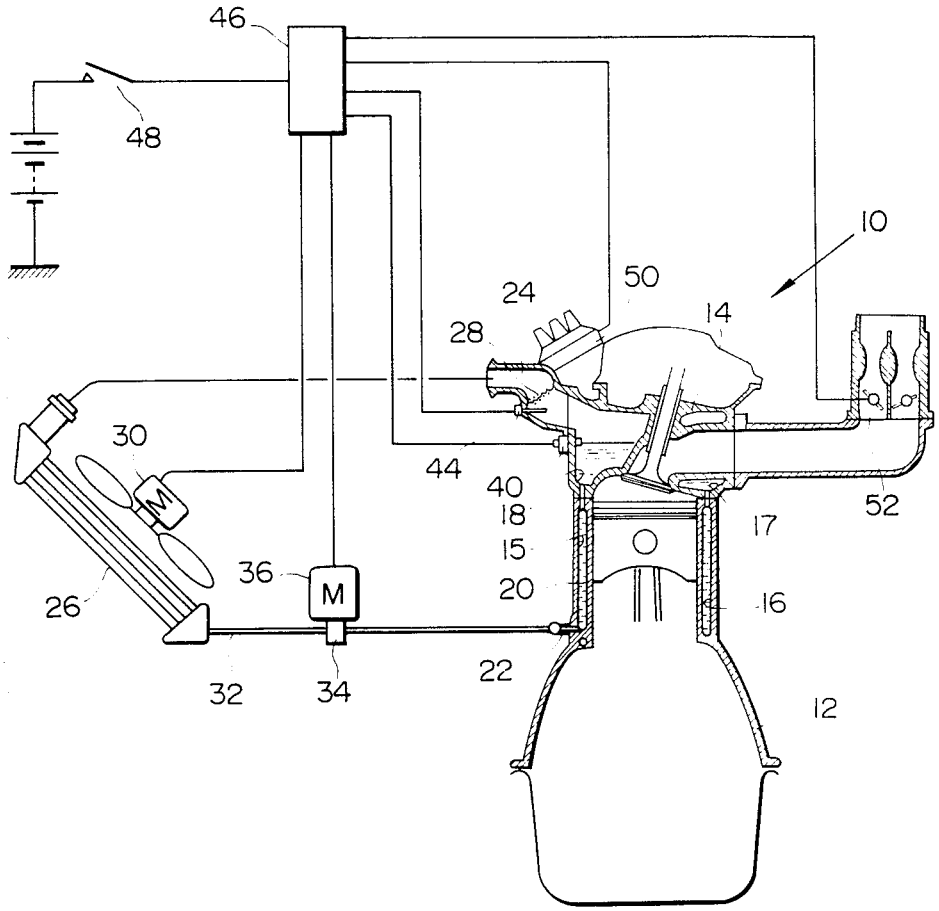
FIG. 1 is a schematic diagram of an engine system incorporating the present invention.

FIG. 1 shows an engine system incorporating the present invention. In this arrangement an internal combustion engine 10 includes a cylinder block 12 on which a cylinder head 14 is detachably secured. The cylinder head and cylinder block include suitable cavities 15–18 which define a coolant jacket 20. In this embodiment the coolant is introduced into the coolant jacket 20 through a port 22 formed in the cylinder block 12 and so as to communicates with a lower level of the coolant jacket 20. Fluidly communicating with a vapor discharge port 24 of the cylinder head 12 is a radiator 26 (heat exchanger). Disposed in the vapor discharge port 24 is a separator 28 which in this embodiment takes the form of a mesh screen. The separator 28 serves to separate the droplets of liquid and/or foam which tend to be produced by the boiling action, from the vapor per se and minimize unecessary liquid loss from the coolant jacket.

Located suitably adjacent the radiator 26 is a electrically driven fan 30. Disposed in a coolant return conduit 32 is a return pump 34. In this embodiment, the pump is driven by an electric motor 36.

In order to control the level of coolant in the coolant jacket, a level sensor 40 is disposed as shown. It will be noted that this sensor is located at a level higher than that of the combustion chambers, exhaust ports and valves (structure subject to high heat flux) so as to maintain same securely immersed in coolant and therefore attenuate engine knocking and the like due to the formation of localized zones of abnormally high temperature or "hot spots".

Located above the level sensor 40 so as to be exposed to the gaseous coolant is a temperature sensor 44 (or alternatively a pressure sensor). The output of the level sensor 40 and the temperature sensor 44 are fed to a control circuit 46 or modulator which is suitably connected with a source of EMF upon closure of a switch 48. This switch of course may advantageously be arranged to be simultaneously closed with the ignition switch of the engine (not shown). The temperature sensor may be arranged to directly sense the temperature of the cylinder head, if desired.

The control circuit 46 further receives an input from the engine distributor 50 indicative of engine speed and an input from a load sensing device 52 such as a throttle position sensor. It will be noted that as an alternative to throttle position, the output of an air flow meter or an induction vacuum sensor may used to indicate load.

Figure 2:
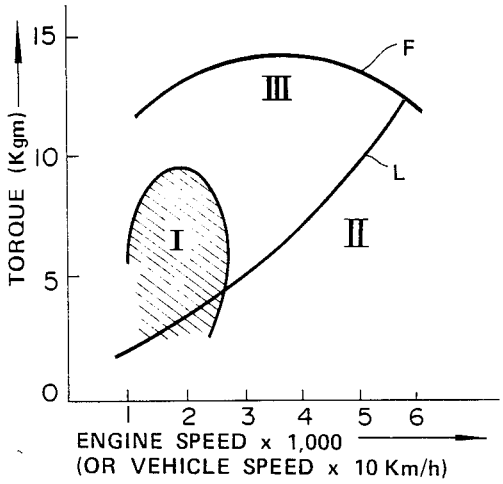
FIG. 2 is a graph plotted in terms of torque and engine speed showing the various load zones in which temperature control is required.

FIG. 2 graphically shows in terms of engine torque and engine speed the various load "zones" which are encountered by an automotive vehicle engine. In this graph, the the curve F denotes full throttle torque characteristics, trace L denotes the resistance encountered when a vehicle is running on a level surface, and zones I, II and III denote respectively "urban cruising", "high speed cruising" and "high load operation" (such as hillclimbing, towing etc.).

A suitable coolant temperature for zone I is approximately 110 degrees C. while 90 - 80 degrees for zones II and III. The high temperature during "urban cruising" of course promotes improved fuel economy while the lower temperatures obviate engine knocking and/or engine damage in the other zones. For operational modes which fall between the aformentioned first, second and third zones, it is possible to maintain the engine coolant temperature at approximately 100 degrees C.

Figure 3:
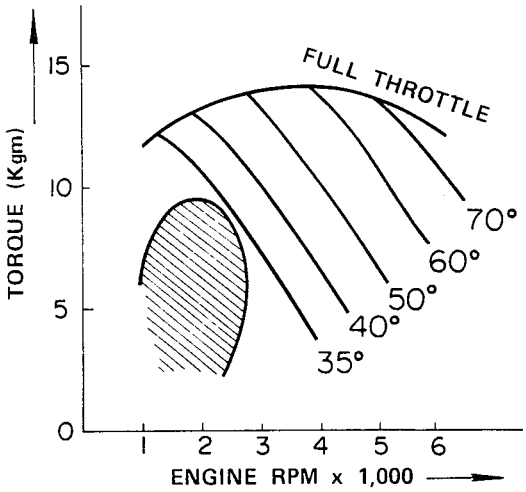
FIG. 3 is a graph similar to that shown in FIG. 2 showing in terms of engine torque and RPM, the torque characteristics which occur at full, 70, 60, 50, 40 and 35 degree throttle openings.

FIG. 3 shows the relationship which occurs between "urban cruising" (indicated by the hatched zone) and throttle opening. As will be appreciated from this figure it is possible, using only the throttle opening as a decision making parameter, to determine approximately if the engine is operating under "urban cruising" conditions or not. Viz., in the illustrated arrangement, upon the throttle opening reaching 35 degrees the engine may be assumed to be operating at a load (and possible or engine speed) at which the temperature of the engine should be lowered from 110 degrees to 80 to 90 degrees.

Figure 4:
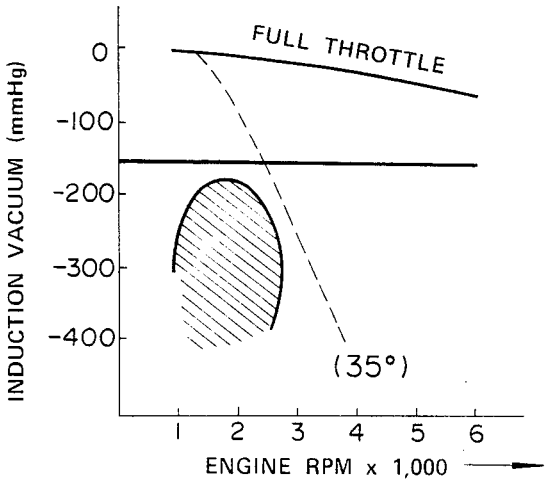
FIG. 4 is a graph plotted in terms of induction vacuum and engine RPM showing a vacuum level below which the engine may be determined to be operating "urban cruising" conditions.

FIG. 4 shows, in terms of engine induction vacuum and engine speed the vacuum level below which the engine may be considered to have entered "urban cruising" operation.

Figure 5:
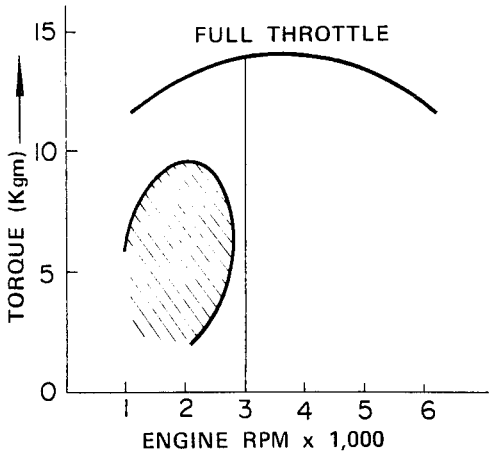
FIG. 5 shows, in terms of engine torque and engine RPM, a level below which the engine may be deemed to be operating in the "urban cruising" zone.

FIG. 5 shows, in terms of engine torque and engine speed, the engine speed below which the engine may be deemed to be operating under "urban cruising" conditions.

Figure 6A:
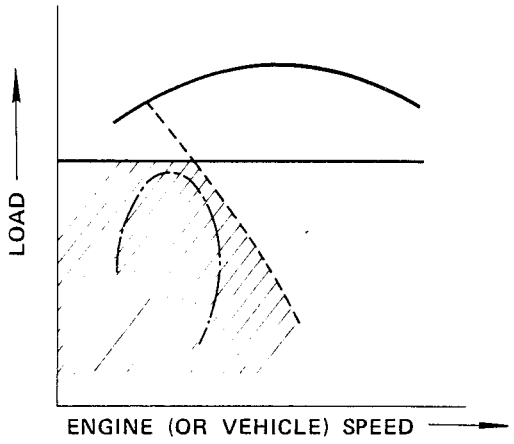
FIGS. 6A to 6C show various fields of control which may be obtained by combining the load/speed characteristics shown in FIGS. 3 & 4, 4 & 5 and 3 & 5, respectively.
Figure 6B:
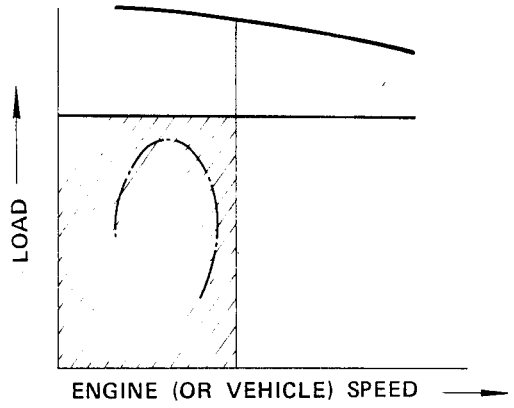
Figure 6C:
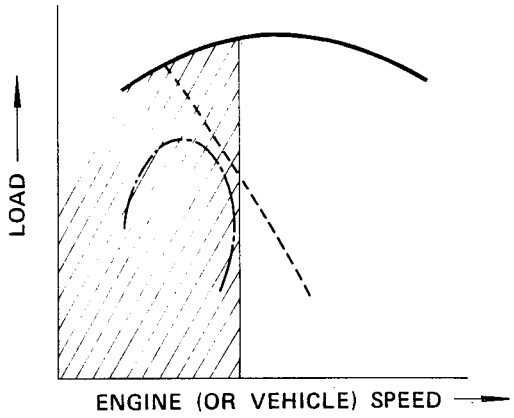

FIGS. 6A to 6C show the results of combining the individual parameters disclosed in FIGS. 3 to 5.

FIG. 6A shows the narrowing of the "control" field (hatched), in which "urban cruising" falls, when induction vacuum and throttle opening (for example 35 degrees) parameters are combined. FIG. 6B shows the field which results from combining the induction vacuum and engine speed parameters, while FIG. 6C shows a field which approximates the urban cruising zone (shown in phantom) which is possible by using the engine speed and throttle opening degree parameters.

As will be appreciated, each of the combinations enables various control possiblities using only two parameters. Of course the use of the three parameters is also possible with a further narrowing of the control field.

With the present invention, in order to control the temperature of the engine, the embodiments thereof take advantage of the fact that with a cooling system wherein the coolant is boiled and the vapor used a heat transfer medium, the amount of coolant actually circulated between the coolant jacket and the radiator is very small, the amount of heat removed from the engine per unit volume of coolant is very high and that upon boiling the pressure and consequently the boiling point of the coolant rises. Thus, by circulating only a predetermined flow of cooling air over the radiator, it is possible reduce the rate of condensation therein and cause the temperature of the engine (during "urban cruising") to rise above 100 degrees for example to approximately 119 degrees C. (corresponding to a pressure of approximately 1.9 Atmospheres). During high speed cruising the natural air draft produced under such conditions may be sufficient to require only infrequent energizations of the fan to induce a condensation rate which reduces the pressure in the coolant jacket to atmospheric or sub-atmospheric levels and therefore lower the engine temperature to between 100 and 80 degrees C. (for example). Of course during hillclimbing, towing and the like, the fan may be frequently energized to achieve the desired low temperature.

Figure 7:
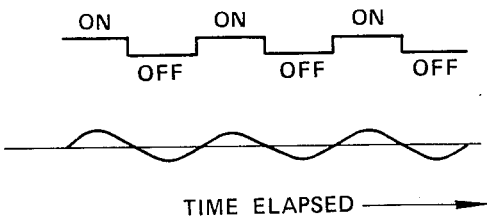
FIG. 7 is time chart showing the energization of the cooling fan and the attendant changes in engine temperature which occur according to a first embodiment of the present invention.

FIG. 7 shows an example of ON - OFF operation of the fan and the resulting temperature of the coolant. Of course the value of $T_O$ is dependant on engine load and speed as will become clear hereinlater.

Figure 8:
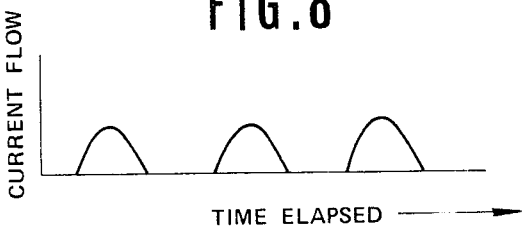
FIG. 8 is a graph showing fan energization characteristics provided by a second embodiment of the present invention.

FIG. 8 shows fan energization characteristics according to a second embodiment of the present invention. In this embodiment the electrical power with which the fan is energized, is gradually increased and decreased to so to smoothly accelerate and decelerate the fan and attenuate the otherwise possibly distracting sudden noise increase and decrease which accompanies immediate full fan energization/de-energization. This particular control feature may be simply realized via the provision of a simple RC circuit (or the like) between the control circuit and the fan motor.

Figure 9:
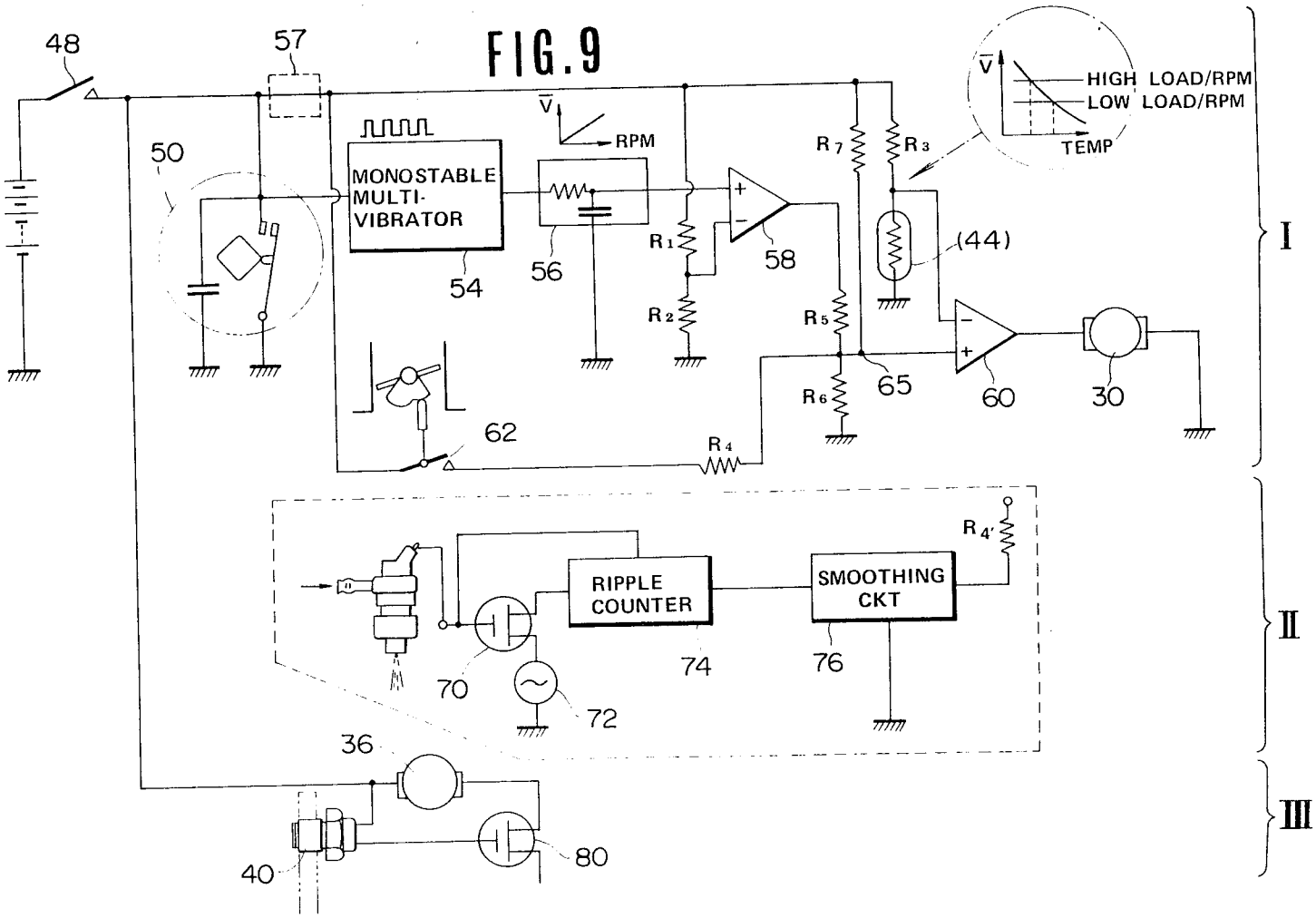
FIG. 9 is a circuit diagram showing an example of circuitry which may be used to control the operation of the first embodiment of the present invention.

FIG. 9 is a circuit diagram showing an example of circuitry contained in the control circuit 46 via which the desired temperature and coolant level control may be affected.

This diagram is divided first, second and third sections, I, II and III. The first section shows the circuitry involved with controlling the fan, the second a possible alternative to the throttle position switch (shown in section I) wherein the fuel injection pulses are used, and III the circuitry involved with maintaining a desired amount of coolant in the coolant jacket.

As shown, in the above mentioned circuitry the distributor 48 of the engine ignition system is connected with the source of EMF (FIG. 1) via the switch 46. A monostable multivibrator 54 which is connected in series between the distributor 48 and a smoothing circuit 56. A DC-DC converter 57 is arranged, as shown in broken line, to ensure a supply of constant voltage to the circuit as a whole. A voltage divider consisting of resistors R1 and R2 provides a comparator 58 with a reference voltage at one input thereof while the second input of said comparator receives the output of the smoothing circuit 56. A second voltage dividing arrangement consisting of a resistor R3 and a thermistor (viz., the temperature sensor 44) applies a reference voltage to a second comparator 60 which receives a signal from a cam operated throttle switch 62 via a resistor arrangement including resistors R4, R5, R6 and R7 connected as shown. The output of the comparator 60 is applied to the fan for energizing same.

Section II of FIG. 9 shows an alternative to the throttle switch arrangement shown in section I. This alternative arrangement includes a transistor 70, a clock circuit 72, a ripple counter 74 and a smoothing circuit 76, all connected as shown. The output of the smoothing circuit 76 is applied via resistor R4' to junction 65. Due to the fact that the frequency of injection control pulses varies with engine speed, it is possible to use this arrangement in place of both of the throttle switch 62 and distributor 50 as will be appreciated by those skilled in the art.

Section III shows a transistor 80 which acts a switch upon receiving an output from the level sensor 40 to establish a circuit between the source of EMF and ground. As a safety measure, an inverter or the like (not shown) may be interposed between the level sensor 40 and the transistor 80, and the level sensor adapted to produce an output when immersed in coolant. With this arrangement should the level sensor malfunction, the lack of output therefrom would cause the transistor 80 to be rendered conductive and the pump 36 energized to overfill the coolant jacket.

The operation of the arrangement shown in section I is such that the frequency of the pulses applied to the monostable multivibrator 54 increase with engine speed whereby the output of the smoothing circuit accordingly increases with engine speed. Upon the output of the smoothing circuit exceeding the voltage produced by the first voltage divider (viz., R1 and R2) the comparator 58 applies an output indicative of the engine speed being above a predetermined level to comparator 60 via junction 65. Thus, depending on the load of the engine being above or below the level at which the throttle switch is triggered and the level of the engine speed signal from comparator 58, the output of the comparator 60 is controlled to maintain the engine temperature at one of a plurality of levels determined by the selection of the various resistors, time constants and the like.

It is possible with the above disclosed circuit to omit the comparator 58 and connect the output of the smoothing circuit 56 directly to resistor R5. This permits the temperature prevailing in the coolant jacket to be gradually changed with change in engine speed.

Engine warm-up (vehicle stationary) is promoted with this arrangement as the temperature of the coolant will be caused to rise to approximately 119 degree (by way of example) before any fan energization due to the presence of signals indicating both load load and low engine speed.

Figure 10:
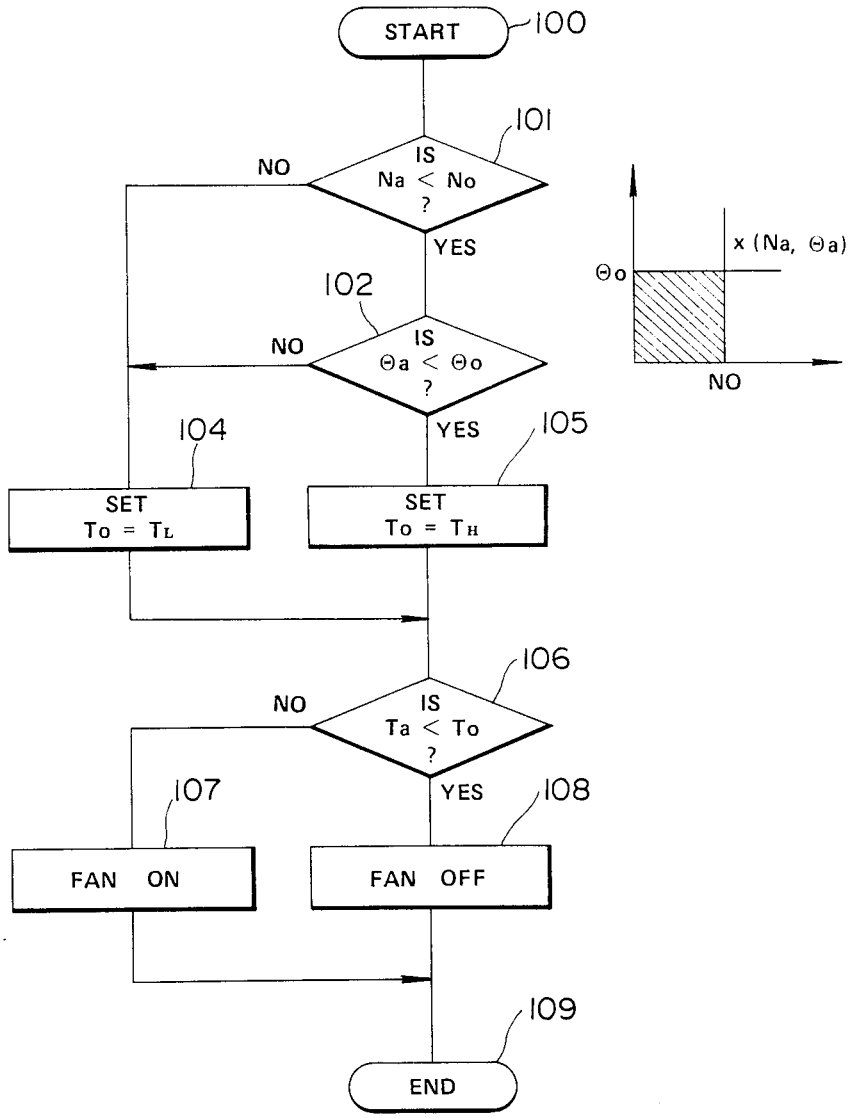

FIG. 10 shows a flow chart which illustrates the steps characterizing a control program which may be executed by an embodiment of the invention in which a microprocessor is utilized. As shown, in this program subsequent to the START thereof at step 100 the enquiry is made at step 101 as to whether the actual engine speed "Na" is less than a predetermined value "No". This predetermined value may be, by way of example only, that shown in FIG. 5 (viz, 3000 RPM). If the answer to this enquiry is YES the program proceeds to step 102 wherein the actual throttle angle $\theta a$ is compared with a predetermined value $\theta o$ such as 35 degrees (see FIG. 3) If the result of this comparison reveals that the actual throttle setting is less than 35 degrees, the program proceeds to step 103 wherein the desired engine temperature $T_o$ is set to $T_H$ Viz., the control temperature is set to 110 degrees (for example). However, if the enquiry posed at step 101 is NO, viz., the actual engine speed Na is above the predetermined value of No, then the program proceeds to step 104 wherein the control temperature is set to $T_L$ (90 degrees for example). If the outcome of the comparision at step 102 reveals that the present throttle setting is above the predetermined value, then the program goes to step 104.

In step 105 the enquiry is made as to whether the actual temperature Ta prevailing in the coolant jacket is less than the target or control temperatures set in steps 103 or 104. If the temperature is greater than the target level the program proceeds to in step 106 to energize the fan (in a manner as depicted in either of FIGS. 7 or 8). However, if the temperature is less than the desired level the fan is switched off or left unenergized as the case may be.

With this arrangement, the control field shown in hatching in the insert adjacent steps 101 and 102, is controlled in a manner that the higher temperature $T_H$ (110 degrees C.) is maintained therein while the lower temperature $T_L$ (90 degrees C.) is maintained in the areas external of the hatched one.

This embodiment of the invention provides a control similar to that depicted in FIG. 6B.

Of course it is possible when using microprocessors to more precisely log the "urban cruising" zone shown in hatching in FIG. 2 in the form of a look-up table and set same in a ROM.

Further variations to the above embodiments will be deemed within the ready perview of one with skill in the art to which the present invention pertains, and as such no further description given.

Figure 11:
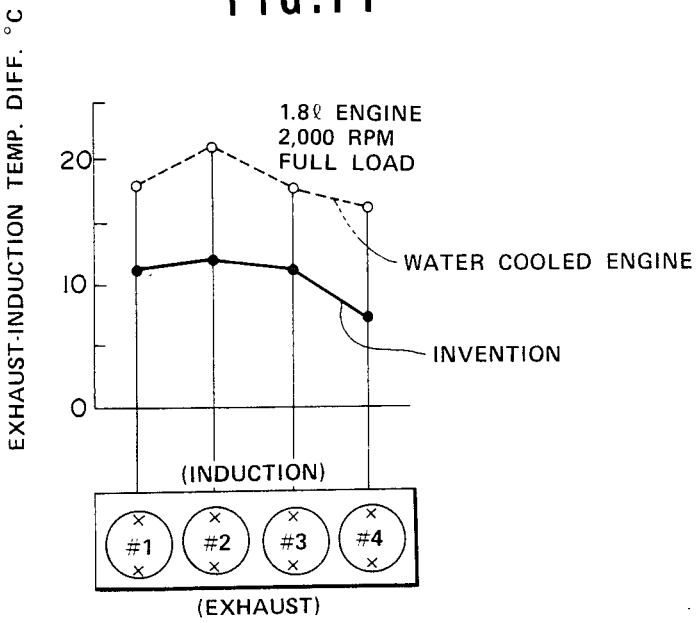
FIG. 11 is a diagram showing in terms of the temperature difference which occurs between the induction and exhaust sides of an inline four cylinder engine, the difference in temperature uniformity achieved by the present invention and by the previously mentioned conventional water circulation type cooling system.

FIG. 11 graphically shows one of the merits of the present invention. In this figure the broken line trace indicates the temperature difference which occurs with the conventional water circulation type cooling system, between the "induction" and "exhaust" sides of a "cross-flow type" four cylinder inline engine, while the solid line trace indicates that which occurs with the present invention. As shown, with the present invention the temperature difference is notably lower indicating a greater uniformity of temperature throughout the engine structure.

What is claimed is:

1. In an internal combustion engine means defining a coolant jacket into which coolant is introduced in a liquid form and discharged in a gaseous state;

a radiator fluidly connected with said coolant jacket for receiving gaseous coolant therefrom and condensing same to its liquid state;

a device for controlling the amount of heat removed from said radiator;

a first sensor for sensing one of the pressure and temperature prevailing within said coolant jacket;

a second sensor for sensing the load on said engine;

a third sensor for sensing the rotational speed of said engine; and a circuit responsive to said first, second and third sensors for controlling the operation of said device in a manner to vary the temperature and pressure prevailing in said coolant jacket in response to the output of said second and third sensors.

2. In an internal combustion engine:

means defining a coolant jacket into which coolant is introduced in a liquid form and discharged in a gaseous state;

a radiator fluidly connected with said coolant jacket for receiving gaseous coolant therefrom and condensing same to its liquid state;

a device for controlling the amount of heat removed from said radiator;

a first sensor for sensing one of the pressure and temperature prevailing within said coolant jacket;

a second sensor for sensing the load on said engine;

a third sensor for sensing the rotational speed of said engine;

a circuit responsive to said first, second and third sensors for controlling the operation of said device in a manner to vary the temperature and pressure prevailing in said coolant jacket in response to the output of said second and third sensors;

a pump for recycling condensed coolant from said radiator to said coolant jacket; and a level sensor disposed in said coolant jacket above structure thereof subject to high heat flux, said control circuit being responsive to the output of said level sensor for controlling said pump in a manner to maintain the level of coolant in said coolant jacket at a level above said structure.

3. An internal combustion engine as claimed in claim 2, wherein said device takes the form of a fan which induces a flow of cooling air to pass over said radiator, and wherein said control circuit intermittently energizes said fan in a manner that the frequency of the energizations varies as a function of engine speed and engine load.

4. An internal combustion engine as claimed in claim 2, wherein said control circuit is arranged to gradually increase the power with which said fan is energized to attenuate noise generation.

5. An internal combustion engine as claimed in claim 2, wherein said load sensor takes the form of a switch which is triggered upon a throttle valve of said engine being opened by a predetermined amount.

6. A method of operating an internal combustion engine comprising the steps of:

introducing coolant into a coolant jacket of the engine in a liquid form;

discharging said coolant from said coolant jacket in a gaseous form;

condensing the gaseous coolant discharged from said coolant jacket in a radiator;

sensing the load on said engine;

sensing the rotational speed of said engine;

controlling the rate of condensation in said radiator in response to the sensed engine load and sensed engine rotational speed, so as to control the temperature prevailing in said coolant jacket to a level appropriate for the sensed load and engine rotational speed.

7. A method as claimed in claim 6, further comprising the steps of:

sensing the level of coolant in said coolant jacket; and recycling the condensed coolant from said radiator to said coolant jacket in a manner to maintain a predetermined coolant level in said coolant jacket.

8. A method as claimed in claim 6, wherein said step of controlling includes the step of intermittently energizing a fan to cause a flow of cooling air to flow over the radiator.

9. A method as claimed in claim 8, wherein said step of energizing said fan includes gradually increasing the power with which said fan is energized to attenuate noise generation.

10. In an internal combustion engine having a combustion chamber, a radiator;

a coolant jacket in which coolant is boiled and the vapor produced condensed in said radiator;

a level sensor disposed in said coolant jacket;

means responsive to said level sensor for maintaining the level of liquid coolant in said coolant jacket above said combustion chamber;

a temperature sensor for sensing the temperature of coolant in said coolant jacket; and a device for varying the rate of condensation of said vapor in said radiator in accordance with the output of said temperature sensor.

11. A method of operating an internal combustion engine comprising the steps of:

(a) introducing coolant into a coolant jacket of the engine in a liquid form;

(b) discharging said coolant from said coolant jacket in a gaseous form;

(c) condensing the gaseous coolant discharged from said coolant jacket in a radiator;

(d) sensing the load on said engine;

(e) sensing the rotational speed of said engine;

(f) controlling the rate of condensation in said radiator in response to the sensed engine load and sensed engine rotational speed, so as to control the temperature prevailing in said coolant jacket to a level appropriate for the sensed load and engine rotational speed;

(g) sensing the level of coolant in said coolant jacket; and (h) energizing a pump so as to pump coolant from said radiator to said coolant jacket in response to the level sensed in step (g) in a manner to maintain a predetermined level of coolant in said coolant jacket.

* * * * *